US011291903B2

(12) United States Patent
Watanabe

(10) Patent No.: US 11,291,903 B2
(45) Date of Patent: Apr. 5, 2022

(54) GOLF SWING TRAINING TOOL BASED ON GRIP ANGLE CONTROL

(71) Applicant: Shuichi Watanabe, Isesaki (JP)

(72) Inventor: Shuichi Watanabe, Isesaki (JP)

( * ) Notice: Subject to any disclaimer, the term of this patent is extended or adjusted under 35 U.S.C. 154(b) by 0 days.

(21) Appl. No.: 17/418,365

(22) PCT Filed: Feb. 28, 2019

(86) PCT No.: PCT/JP2019/007932
§ 371 (c)(1),
(2) Date: Jun. 25, 2021

(87) PCT Pub. No.: WO2020/152877
PCT Pub. Date: Jul. 30, 2020

(65) Prior Publication Data

US 2022/0047930 A1 Feb. 17, 2022

(30) Foreign Application Priority Data

Jan. 23, 2019 (JP) ..... JP2019-009242

(51) Int. Cl.
*A63B 69/36* (2006.01)

(52) U.S. Cl.
CPC ..... *A63B 69/36* (2013.01)

(58) Field of Classification Search
CPC ..... A63B 69/36; A63B 69/3608
See application file for complete search history.

(56) References Cited

U.S. PATENT DOCUMENTS 1,655,092 A * 1/1928 Brown ..... A63B 69/0059 473/212
4,890,841 A * 1/1990 Brooks ..... A63B 69/0059 473/212
5,174,575 A * 12/1992 Leith ..... A63B 69/0059 473/213
5,807,218 A * 9/1998 Nagatomo ..... A61F 5/3715 128/869
5,865,685 A * 2/1999 Thomas ..... A63B 69/3608 473/213

(Continued)

FOREIGN PATENT DOCUMENTS

JP 2015-150141 A 8/2015
WO WO-9955432 A1 * 11/1999 ..... A63B 69/0059

OTHER PUBLICATIONS

Japanese Searching Authority, International Search Report and Written Opinion, dated Jun. 18, 2019, 5 pages, Japan Patent Office, Tokyo, Japan.

*Primary Examiner* — Raleigh W Chiu
(74) *Attorney, Agent, or Firm* — Ashkan Najafi

(57) ABSTRACT

A golf swing training tool including an arm band (which connects the elbows) and the club shaft are connected by a cord maintain a prescribed grip angle. The arm band is configured to adjust a distance between the elbows. An elastic clip locks onto the club shaft and is configured to encircle the club shaft, and enables easy changing of the grip angle by using an opening lever to change the locking point with a single touch. As a result, frequent changes in grip angle can be made much more easily. Three types of cords are employed, a low-elasticity cord, a high-elasticity cord, and a cord combining both are used to achieve twelve different types of training methods.

5 Claims, 9 Drawing Sheets

(56) References Cited

U.S. PATENT DOCUMENTS 5,902,189 A * 5/1999 Schultz ..... A63B 69/0059 473/212
5,904,624 A * 5/1999 Martinez ..... A63B 69/0059 473/212
5,938,548 A * 8/1999 Upshaw ..... A63B 21/0004 473/453
6,358,156 B1 * 3/2002 Moran ..... A63B 69/3632 473/212
6,471,598 B2 * 10/2002 Takase ..... A63B 69/0059 473/207
6,514,150 B1 * 2/2003 Corder ..... A63B 69/0059 473/214
7,033,282 B1 * 4/2006 Flood ..... A63B 69/0059 473/219
7,033,284 B2 * 4/2006 Yoshimura ..... A63B 69/3608 473/212
7,156,748 B2 * 1/2007 Burke ..... A63B 69/0059 473/276
7,399,232 B1 * 7/2008 Frappier ..... A63B 21/0004 473/207
9,814,960 B1 * 11/2017 Bertini ..... A63B 69/3608
2003/0176227 A1 * 9/2003 Czaja ..... A63B 69/0059 473/227
2003/0178773 A1 * 9/2003 Meyer ..... A63B 69/0059 273/276
2005/0202896 A1 * 9/2005 Burke ..... A63B 69/0059 473/276
2007/0191129 A1 * 8/2007 Kearns ..... A63B 69/3608 473/212
2009/0258719 A1 * 10/2009 Wortman ..... A63B 69/3608 473/221
2011/0269562 A1 * 11/2011 Pinns ..... A63B 69/0059 473/227
2012/0034988 A1 * 2/2012 Fontanilla ..... A63B 69/36212 473/212
2015/0314186 A1 * 11/2015 Gibson ..... A63B 69/3685 473/227
2020/0061432 A1 * 2/2020 Springman ..... A63B 69/0059
2021/0046371 A1 * 2/2021 Kim ..... A63B 69/3685
2021/0299538 A1 * 9/2021 Arnold ..... A63B 69/3632

* cited by examiner

| Clubs → | ・wood<br>・iron<br>・wedge<br>・putter | ・iron<br>・to take turf | ・wood<br>・iron | ・wood<br>・iron | ・wood<br>・iron |
|---|---|---|---|---|---|
| Strings ↓ Swings→ | horizontal arc swing | inclined arc swing | accumulating energy | follow impact | full swing |
| low elasticity string like member | very good | very good | very good | can't use | can't use |
| high elasticity string like member | good | very good | very good | very good | very good |
| composite string like member | not so good | not so good | not so good | good | very good |

FIGURE 11

GOLF SWING TRAINING TOOL BASED ON GRIP ANGLE CONTROL

CROSS REFERENCE TO RELATED APPLICATIONS

This is a National Phase Entry Application claiming priority to and the benefit of Patent Cooperation Treaty application no. PCT/JP2019/007932, filed on Feb. 28, 2019, currently pending, which claims priority to and the benefit of Japanese patent application no. 2019-009242 filed Jan. 23, 2019, currently pending, each incorporated by reference herein.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to golf swing training apparatuses and, more particularly, to a golf swing training apparatus for controlling a grip angle.

Prior Art

Since the word grip angle exists in the golf world but is rarely used, it seems that awareness of grip angle is low. Therefore, there are very few practice tools for grip angle. The word grip angle is often used in this patent application, but as mentioned above, the word grip angle is not widely used, so we define it. It also defines other terms.

Definition of Terms

Grip angle: In a right-handed golfer, the angle formed by the club shaft and the left arm, 25 in FIG. 2. (Although it can be defined as "the angle created by the club shaft and both arms"), the right arm of a right-handed golfer bends to about 90 to 180 degrees. The left arm of a right-handed golfer is almost straight except for the finish, so the above definition is applied.

00 o'clock: The position of the grip 29 is expressed by the clock face. 8 o'clock is the lower right position and 3 o'clock is the left side position. Business zone: The swing range of grip 29 from about 8:00 to about 4:00. Address grip angle: Grip angle at the time of address (about 150 degrees). Cock: Reduce the grip angle during the swing. Uncock: Increasing the grip angle during a swing (also called release). Over Uncock: The grip angle becomes larger than the specified grip angle during the swing. Accumulating energy: Keep the grip angle small with a downswing (about 90 degrees). You can use energy. Full swing: A downswing from about 11:00, a swing in the business zone, a follow swing, and a finish. (It's not about swinging with all your might.)

In Patent Document 1, it is described in the 7th line of the detailed description of the invention that "the moving arc of the club head must be strict. (Omitted in 2 lines), in particular, it is important to keep the diameter of the moving arc constant." However, this is not a recommended swing, not a general swing, but an irregular swing. In the top position, the club head is close to the golfer's body and the club head swings down while staying close to the body, then moves away from the body to make an impact, and when the turf is taken after the impact, it is the farthest from the body. It is impossible to control the ball if you do what Patent Document 1 says "it is important to keep the arc diameter constant". Also, you can never hit a spinning ball with an iron. The part of the movement of the club head is close to an arc, but the swing as a whole is not an arc. As a typical example, when the grip comes to the lower right on the downswing of Tiger Woods, an American professional golfer, the grip angle is 90 degrees or less, the club head passes near the body, and then the head is released at once and the head is moved away from the body. Next, hit the ball. Making the "moving arc orbit constant" as referred to in Patent Document 1 is the biggest mistake made by golfers trying to master the recommended general golf swing. The size of the club head trajectory of a golf swing must be constantly changed. The belief that "the club head must be swung in a rounded arc" described in Patent Document 1 hinders the improvement of golf by general golfers. Even if Patent Document 1 is granted a patent, it will be a misguided solution for misplaced problems. On the other hand, the present invention is an invention of a practice tool for practicing and realizing the ever-changing distance between the club head and the body, and the means for solving the problem is also different from Patent Document 1. Furthermore, the invention of Patent Document 1 is complicated, heavy and impractical.

In Patent Document 2, the mechanism requires two sets of double metal pipes having a very complicated structure, so it is considered to be heavy and unsuitable for practical use.

Patent Document 3 is a practice tool that uses only one type of elastic cord, and practice using this is only a normal swing. However, in my invention, 12 kinds of practice methods can be performed by properly using 3 kinds of cords, low elasticity cord, high elasticity cord, and composite cord. By practicing 12 types of techniques, you can easily master the techniques required for swinging, such as maintaining a predetermined grip angle and approaching both elbows, which are techniques that golfers who cannot become advanced golfers are particularly lacking. Therefore, my invention with three kinds of codes is epoch-making.

In Patent Document 3, since the bracelet band is attached to the left arm, there is a high possibility that the elastic cord will come into contact with the golfer's neck or head and interfere with the swing when the golfer makes a full swing. Why is one end of the elastic cord not locked to the bracelet band in FIG. 3A of Patent Document 3? In Patent Document 3, when the bracelet band is attached to the right arm, the above problem is solved, but a new problem arises, that is, the elbow of the right arm is greatly bent when trying to take back, so that the muscles are raised and the take back cannot be performed. If the bracelet band is loosened to solve the problem, the bracelet band cannot be fixed to the arm. This is a defect of Patent Document 3. Since the two-arm band of my invention is fixed to both arms, there is no problem in loosening the arm tightening band of the right arm until takeback is possible, and in the two-arm band, the cord is locked in the center between both elbows. Therefore, the cord does not come into contact with the body. Furthermore, in my invention, one end of the cord is locked in the middle of both arm bands, so the movement of both elbows is transmitted to the cord.

One of the most important points of a golf swing is the rotation of both arms (adduction and abduction). Both elbows need to be close to each other to achieve this rotation. The bracelet band of Patent Document 3 does not have a function of bringing both elbows close to each other, but the bracelet band of my invention has a function of bringing both elbows close to each other. It is an important factor for learning the ideal swing. Therefore, my invention with a two-armed band is groundbreaking.

The connector FIG. 6A and clip attachment FIG. 7 of Patent Document 3 are types that use bolts and nuts. Since the procedure for changing these locking positions is "loosening the bolt, moving the locking position, and tightening the bolt", it takes time and effort. These are effective if the locking position is not changed frequently. However, since my invention has 3 kinds of cords and 12 kinds of practice methods, the locking position is changed frequently, so in my invention, I invented a fastener that can move the locking position with one touch. The time required to change the locking position of the fastener of my invention is within 3 seconds, which simplifies the use of my invention. The fasteners of my invention are very effective and important in using my invention. With regard to the clips of FIG. 4 and FIG. 5 of Patent Document 3, there is a high possibility that the clips will come off due to the tension of the rubber in that mechanism. Therefore, my invention with a fastener that makes it easy to change the locking one is epoch-making.

Regarding paragraph [0013] of Patent Document 3, the usage of Patent Document 3 is basically only to swing, and it is said that the club moves on the swing plane by feeling the tension of the rubber at that time, but how does the tension of the rubber work. There is no explanation as to whether the club moves on the working swing plane. Whether or not the golf club has a swing plane is basically independent of the tension of the rubber.

Patent Document 3, paragraph [0015] states that "properly releasing . . . is one of the elusive emotions . . . . This device creates this sensation . . . ", but the reason why the sensation can be created is not written. The practice method is written as "simply swinging . . . makes it easy to find", but golf swings are not that simple. Therefore, the invention of Patent Document 3 is close to a desk theory. To give just one example, non-advanced golfers cannot make accumulating energy because they uncork the grip angle at the same time as the beginning of downswing. There is a release because there is accumulating energy. A release without accumulating is meaningless and has bad consequences. Patent Document 3 does not have a practice method for making accumulating energy, and the code used in Patent Document 3 is only an elastic string. With this, the effect of learning accumulating energy and release cannot be expected. (In rare cases, there are golfers who do not reduce the grip angle when taking back of the club, that is, a swing with "no cock." In this swing, release is not required.)

My invention is the invention that turns the above-mentioned "elusive emotions" into "clear emotions", and the overall swing technology including release in the downswing zone, business zone and follow zone is individually "practiced by the use of low elasticity cord". My invention of mastering "images" by using low elastic cord, and after that using highly elastic cords and composite cords for their mastery is a groundbreaking practice tool.

My invention, which combines a bracelet band that facilitates rotation, three cords that enable twelve practice methods, and one-touch fasteners, has the novelty of allowing golfers to master the ideal golf swing.

Prior Art Literature: Patent Documents

Patent Document 1: U.S. Pat. No. 3,874,601
Patent Document 2: Patent Application Publication No. 57-96667
Patent Document 3: US2005202896 (A1)

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a golf swing training apparatus for controlling a grip angle. These and other objects, features, and advantages of the non-limiting exemplary embodiment(s) are provided by a golf swing training tool including a pair of arm tightening bands configured to be worn at a left arm and a right arm of the user, an arm tightening connecting body connecting the pair of arm tightening bands together, a fastener locked to an existing golf club shaft, a grip angle defined between one of the left arm and the right arm of the user as well as a longitudinal length of the existing golf club shaft, and a string-shaped member having one end locked to the arm tightening connecting body, and further having an opposite end locked to the fastener. Advantageously, the pair of arm tightening bands are configured to cooperate with the arm tightening connecting body and restrict a distance between a left elbow and a right elbow of the user. Advantageously, the string-shaped member is configured to restrict a distance between the arm tightening connecting body and the fastener and thereby prohibit the grip angle from becoming larger than a predetermined grip angle.

In a non-limiting exemplary embodiment, the fastener is elastic and wrapped about the golf club shaft, wherein the fastener is configured to be adjustably locked along the longitudinal length of the golf club shaft to selectively change the predetermined grip angle.

In a non-limiting exemplary embodiment, a longitudinal length of the arm tightening connecting body is selectively adjustable and configured to selectively adjust the distance between the left elbow and the right elbow of the user.

In a non-limiting exemplary embodiment, the string-shaped member includes a hook locked to the fastener and the arm tightening connecting body, respectively, wherein the hooks are configured to smoothly transmit movement of the left elbow and the right elbow to the string-shaped member.

In a non-limiting exemplary embodiment, the string-shaped member includes a first string-shaped member having a low elasticity, and a second string-shaped member having a high elasticity.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 3:
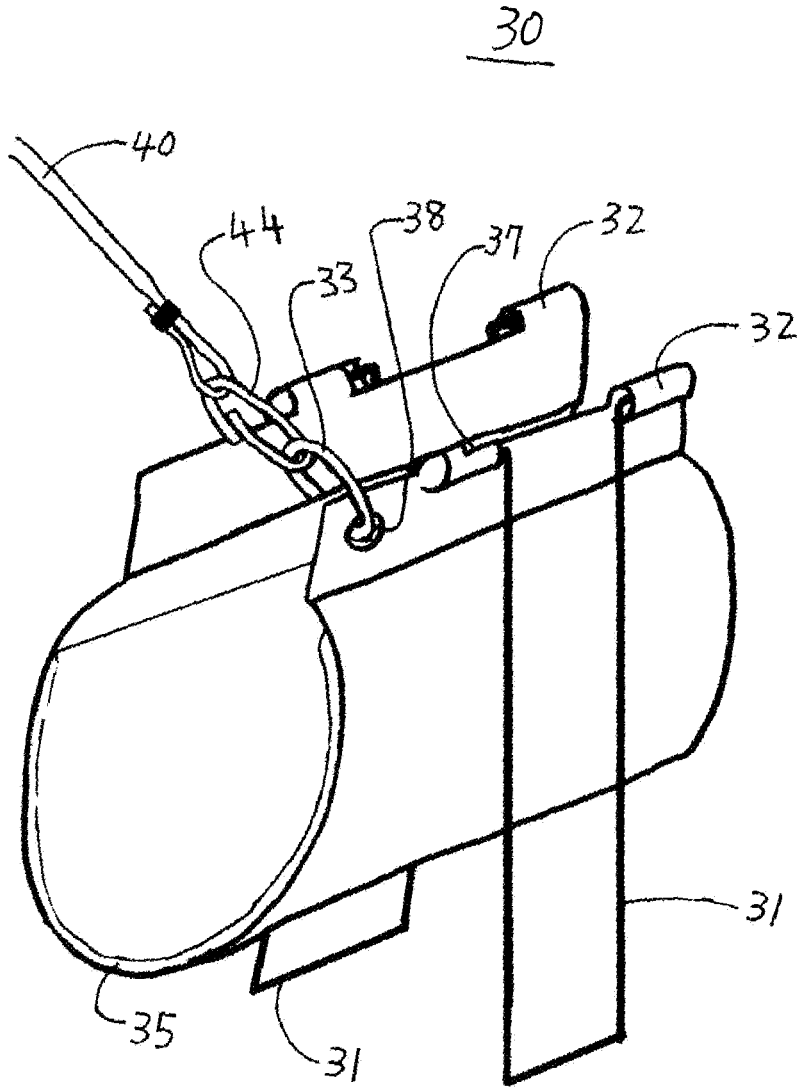

FIG. 3 illustrates the string-shaped member tip hook 44 is attached to the fastener 30, the open lever 31 is in the tilted state.

Figure 4:
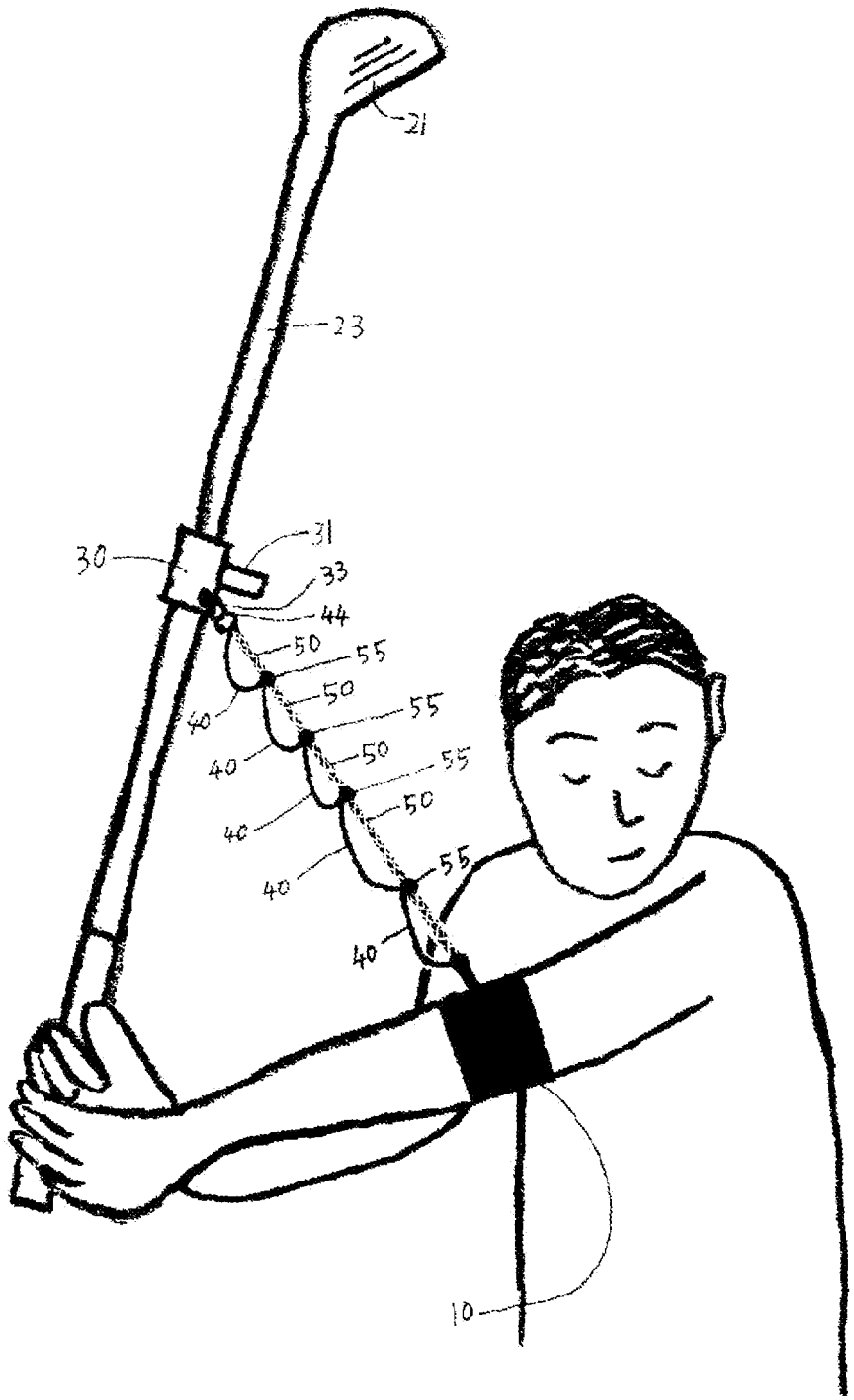

FIG. 4 illustrates a composite string-like member 60 in which a high-elasticity string-like member 50 and a low-elasticity string-like member 40 are bundled. In the business zone, the high elasticity string member 50 does not increase the grip angle, and in the business zone, the low elasticity string member 40 does not increase the grip angle.

Figure 5:
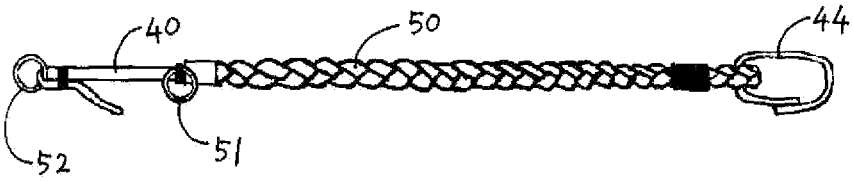

FIG. 5 illustrates a highly elastic string-like member 50 in which several highly elastic string members are bundled. A high-elasticity string-like member 50 that can protect safety even if one high-elasticity string material is broken because it is bundled. As an example of how to bundle, three high-elasticity string materials are bundled in a braid. The mounting positions of the two rings are determined by the golfer's body and swing posture when using the present invention for the first time.

Figure 6:
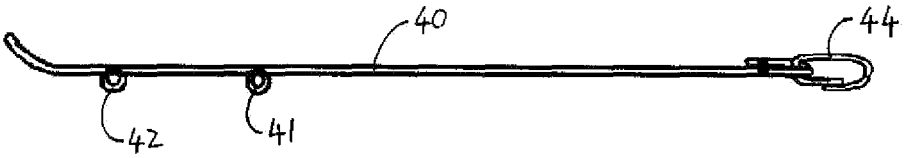

FIG. 6 illustrates a low elastic string-like member 40. The mounting positions of the two rings are determined by the golfer's body and swing posture when using the present invention for the first time.

Figure 7:
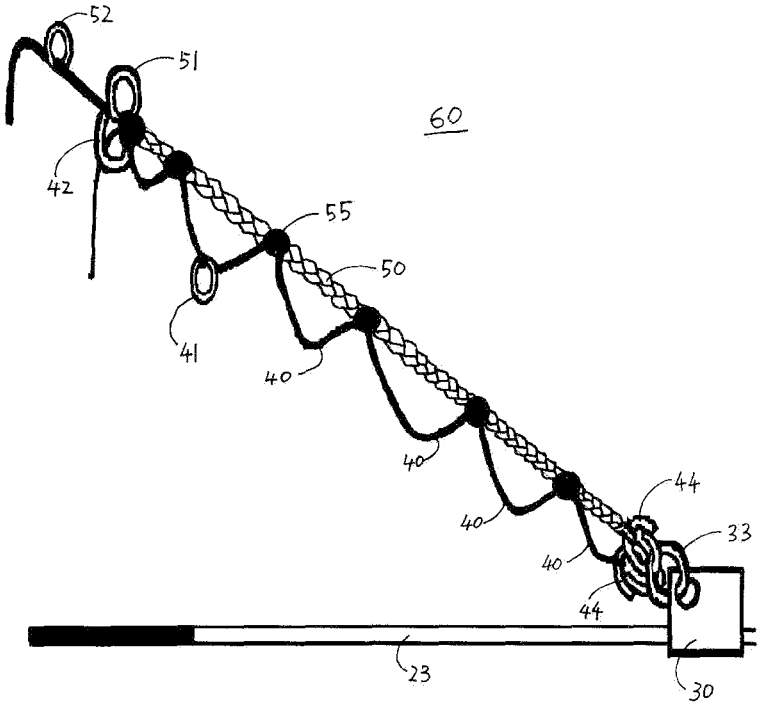

FIG. 7 illustrates a composite string-like member 60 in which a high-elasticity string-like member 50 and a low-elasticity string-like member 40 are bundled.

Figure 8:
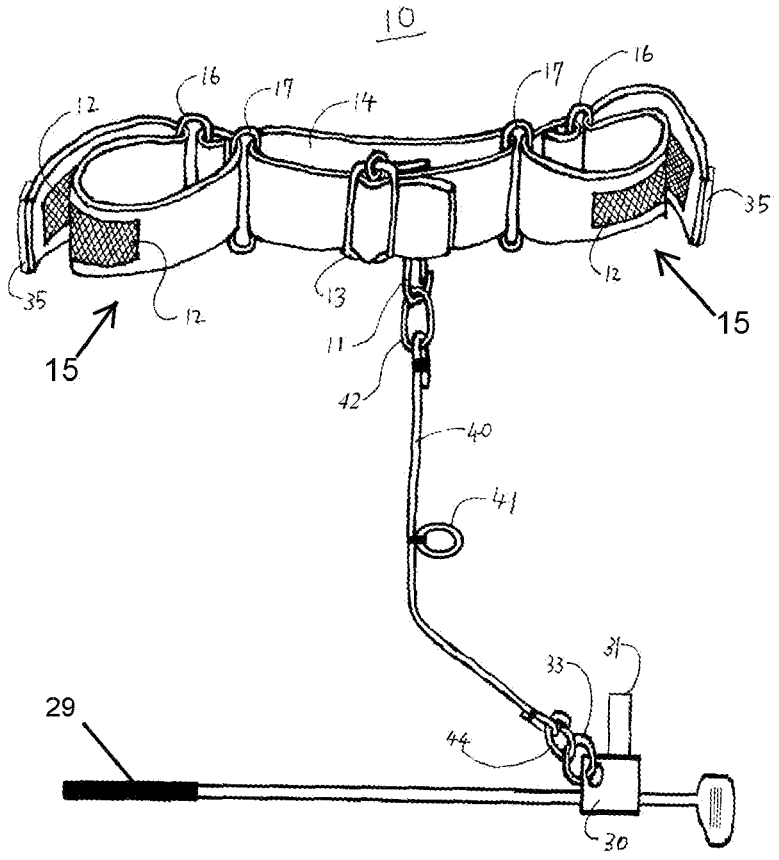

FIG. 8 illustrates a two-arm band 10. There are arm tightening bands 15 on both sides of the central arm tightening connecting body 14. And the two-arm tightening band 15 and the central arm tightening connecting body 14 are connected by two connecting tools 17. The golf club is drawn smaller than the two-arm band 10.

Figure 9:
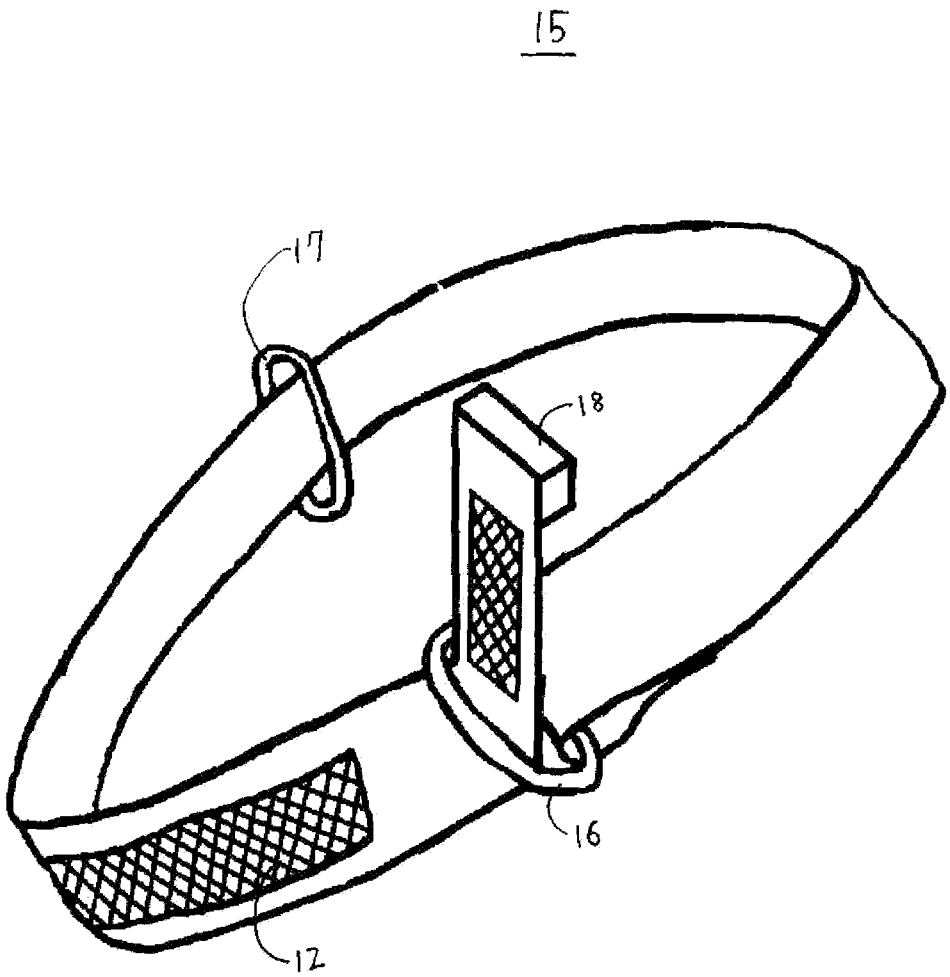

FIG. 9 illustrates the arm tightening band 15 of the arm band 10 so that the mechanism of the arm band 10 can be easily understood. It can be operated with one hand because it is only necessary to lift and tilt the band removal prevention tool 18 and lock it on the hook-and-loop fastener 12. The band stopper 18 prevents the arm tightening band 15 from coming off the arm tightening tool 16.

Figure 10:
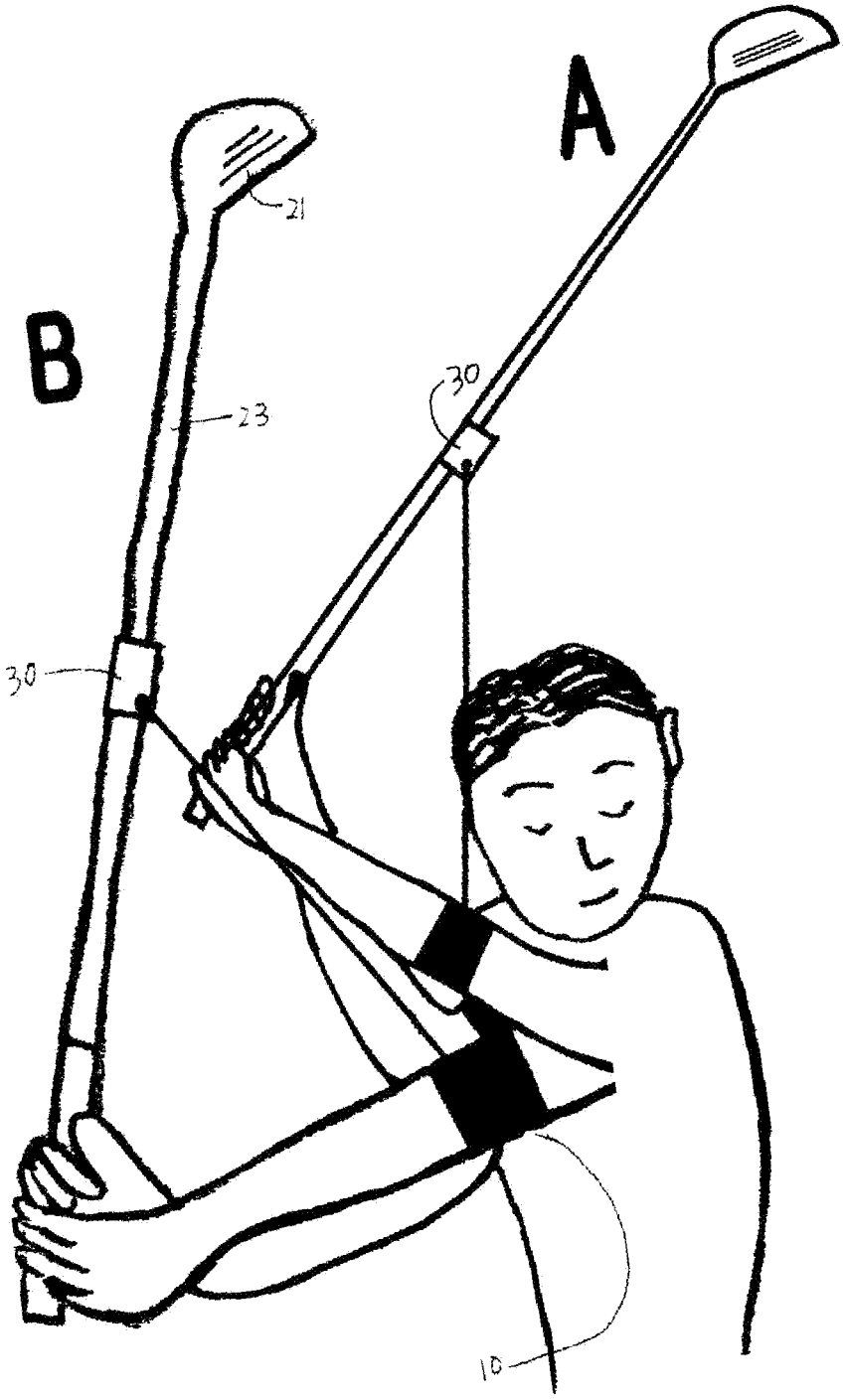

FIG. 10 illustrates a continuous view of a downswing explaining how to make an accumulating energy. The part where the club in FIG. 10 is taken back to 10 o'clock is referred to as A in FIG. 10, and the part where the club is lowered to 8 o'clock is referred to as B in FIG. 10. The arm A in FIG. 10 is facing the back of the page, so the arm is short. In A of FIG. 10, the string-like member seems to touch the golfer's head, but the arm band 10 is near the right ear but does not touch it.

FIG. 11 illustrates twelve types of practice menus that can be performed by the present invention.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about," "generally," and "approximately" mean nearly and in the context of a numerical value or range set forth means±15% of the numerical.

If used herein, "substantially" means largely if not wholly that which is specified but so close that the difference is insignificant.

The non-limiting exemplary embodiment(s) is/are referred to generally in FIGS. 1-11 and is/are intended to provide a golf swing training apparatus for controlling a grip angle.

OUTLINE OF THE INVENTION

Problems to be solved by the invention Both right-handed golfers and left-handed golfers can use my invention, but unless otherwise noted, the entire patent application assumes that the golfer is a right-handed golfer.

When rotating the right arm so much that the palm of the right hand touches the left shoulder, it is natural to rotate the right arm once for each rotation and then for one adduction and abduction. Even in a golf swing, the adduction of the right arm (abduction of the left arm) is a natural movement, and in addition, unlike baseball, golf requires the ball to be launched accurately in the target direction, so the right palm is vertical at impact. The adduction of the right arm (abduction of the left arm) is an indispensable movement because it is also necessary to be. Since the adduction of the right arm (abduction of the left arm) is almost half completed by the impact, the adduction of the right arm (abduction of the left arm) continues even after the impact. In this patent application, I describe the accumulating energy in the downswing zone and the release (the abduction of the right arm and the abduction of the left arm), which occur in the end of the downswing, as "vertical swing". All right arm adductions and left arm abductions during a swing, including within the business zone, are "rotations". By the way, the movement of the club head in the business zone is not an arc movement, but it is close to an arc movement, so in this patent application, the swing in the business zone is expressed as "horizontal arc swing".

Vertical swing has the important function of smoothly changing the club head that moves to the right from the top position to the movement to the left, and making the face of the club head face the ball. In order to swing vertically, it is necessary to keep the grip angle around 90 degrees on the downswing and let the club head pass near the body. Keeping the grip angle around 90 degrees and letting the club head descend near the body from the top position is called making an accumulating energy. According to an article in the Oct. 31, 2017 issue of Weekly Golf Digest Magazine, which published the measurement results of the latest golf swing analyzer "Science Fit", it is reported that amateur golfers clearly have less accumulating energy. The Radius of the club head of a professional golfer during takeback is large and that during a downswing is small. This means that a professional golfer accumulates energy in the downswing. Depending on the golfer, there are early vertical swings that are performed around 8 o'clock with less energy, and late vertical swings that are performed around 7 o'clock with much energy. However, accumulating energy and vertical swing are essential movements for a golf swing. And the descent of the club with an accumulating energy automatically causes a vertical swing.

It is very difficult for golfers to acquire vertical swing because vertical swing is a movement that people rarely experience in daily life. Mr. Izumi Kuwata, who won Japan's first PGA Teaching Pro Award for the highest award in 2010, teaches that "turn your right and left hands upside down with a downswing", but this means that you should rotate with a downswing. It is the vertical swing itself. However, it is difficult for a golfer who has no accumulating energy to "turn over his right and left hands" after the uncock starts at the start of the downswing. Mr. Koji Wakabayashi recommends "Poke your right hand, Z hitting method" in golf magazines, but this is also a vertical swing. However, the expression "poke" does not give an image. There is also an instruction to "swing like throwing a rag to the lower right". This also means to swing vertically, but the difference between a rag and a long club is so different that I can hardly imagine it. It is difficult to get the image of vertical swing with any teaching method. Swinging the club vertically is even more difficult.

I am troubled by management of duffing and topping the balls in the business zone. A swing that hits the ball cleanly and accurately and takes a turf after impact is a dream for amateur golfers, but the present invention allows you to practice for that. I named the swing method of striking the turf after impact "tilted arc swing".

In order to achieve accurate impact by performing vertical swing in the downswing zone and horizontal arc swing or inclined arc swing in the business zone. the grip angle increases until address grip angle, after accumulating energy by the small grip angle at the start of the downswing. Next the club head enters the business zone with address grip angle. It is important to have an impact of the ball with address grip angle. The reason is that golf swings tend to be over-uncocked. Also, the golfer's belief that the club head must be swung in a circular orbit causes over-uncocking. It is important to be aware of the specified grip angle and perform rotation at that grip angle.

Therefore, the challenge is to realize a golf practice tool that prevents the size of the grip angle from becoming larger than the specified angle at each position of the grip from the top to the impact and the follow.

Means to Solve Problems

In a golf practice tool for preventing the grip angle from becoming larger than a predetermined size, the arm band 10 includes two arm tightening bands 15 locked to the upper left arm and the upper right arm and an arm tightening connecting body 14 connecting the two arm tightening bands 15. It is provided with both arm bands for keeping the distance between the right elbow and the right elbow, a fastener for locking to the club shaft, and a string-like member for preventing the grip angle from becoming larger than the predetermined angle. By locking one end of the member to the arm fastening band connecting body and locking the other end to the fastener and connecting the both arm bands and the club shaft with the string-shaped member, the grip angle doesn't become larger than a predetermined size. It is a golf swing practice tool with a mechanism that can change the size of the predetermined angle, which is characterized by not becoming large.

The fastener is made of an elastic material and has a shape that wraps the club shaft, and is pressed against the outer peripheral surface of the club shaft on the inner side surface to lock the club shaft. It is a golf swing practice tool with a mechanism that makes it possible to change the predetermined size of the grip angle by changing the position where it engages with the club shaft.

The both arm tightening bands 15 lock the arm-tightening connecting body 14 that joins one end of the string-like member in order to lock one end of the string-like member to the central portion between the elbows. The length of the arm-tightening connecting body 14 is adjustable to allow the movement of both elbows to be transmitted to the string-like member and to set the distance between the elbows to a predetermined distance. It is a golf swing practice tool that easily smoothens the adduction and abduction of both arms.

The string-like member includes a string-like member having low elasticity and a string-like member having high elasticity, and these are a string-like member having low elasticity like a twine and a high-elasticity string-like member 50 having elasticity like a rubber string. A string-like member having an elongation of about 15 mm when a tension of 16 Newton is applied to a 62 cm string-like portion is defined as a low-elasticity string-like member 40, and the string-like member has an elongation greater than the elongation value under the same conditions is a highly elastic string-like member 50. It is a golf swing practice tool with a mechanism that enables various exercises by using the string-shaped member with low elasticity and the string-shaped member with high elasticity individually or in combination.

Effect of the Invention

The present invention can be used by either right-handed or left-handed golfers. By using the present invention, it is possible to instantly obtain images of horizontal arc swing, and inclination arc swing which can take turf, required for golf swing in the business zone, and vertical swing in the downswing zone. Golfers who do not improve will understand the essence of golf swing in a short time and improve in a short period of time. It can also be used for swing checks of advanced swings in general. If you use the present invention, you can learn the ideal swing with just a few explanations. Since the specified grip angle can be maintained, over-uncocking is reduced in the business zone, topping and duffing which are both caused by stretching are reduced, and the approach shot is better. If there is a stretch, the string-like member lifts the club shaft, so you can immediately notice the stretch.

In the present invention, the ball can be hit accurately by maintaining a predetermined grip angle in all clubs from putters to drivers. You can actually hit the ball as well as swinging. Vertical swing in the downswing has the function of smoothly changing the movement of the club head to the right to the movement of the club head to the left, and the function of making the face of the club head face the ball. An uncock that is too early in the downswing is an over uncock, and since the club head 21 which moves away from the body and takes time until impact, the club head 21 does not yet reach the ball position even if the golfer's upper body rotates and faces the ball. You can improve your swing by maintaining the grip angle, which is annoying for golfers. As a result, it has the effect of reducing pushouts and slice balls caused by delays in swinging. The club head speed can be increased because the movement of the club head to the right can be smoothly changed to the movement to the left.

The basic condition for smooth rotation of both arms, which is essential for golf swings, is that the distance between both elbows is small. The arm tightening connecting body 14 can set the distance between the elbows to a predetermined distance, and the distance between the elbows is not larger than the predetermined distance, which facilitates the rotation. The movement of both elbows is transmitted to the string-shaped member by locking one end of the string-shaped member to the arm tightening connecting body 14 at the center of the right and left elbows. The left arm tightening band 15 can be attached and detached with one touch with the right hand. The same applies to the attachment and detachment of the right arm tightening band 15, and no help from others is required. Practice using only the low-elasticity string-like member 40 of the present invention, practice using only the high-elasticity string-like member 50, and using the composite string-like member 60 in which the low-elasticity string-like member 40 and the high-elasticity string-like member 50 are bundled. In addition to practice, you can practice using these string-shaped members in each zone of the downswing zone, business zone and follow zone, so you can practice various things. Since the low-elasticity string-like member 40, the high-elasticity string-like member 50, the composite string-like member 60, and both arm bands 10 are light, there is no problem in swinging or hitting the ball. (As a reference value, the prototype weighed about 157 grams with the arm band 10, the low elasticity string member 40, and the fastener 30).

The present invention can be used by men and women, children, and the elderly. You can use the present invention without processing any important clubs that are expensive or attached.

Hooks and rings are provided on both ends of the string-shaped member, and the string-shaped member can be easily replaced because it can be easily locked to both arm bands 10 and the fastener 30.

The grip angle can be finely adjusted by changing the locking position of the fastener 30 that is locked to the club shaft, but it can be done within 3 seconds. Since the high-elasticity string-like member 50 bundles several high-elasticity string materials, it is a mechanism that can ensure safety even if one is broken.

MODE FOR CARRYING OUT THE INVENTION

In a golf swing, a swing with an over-uncocked grip angle does not hit the ball well. This is because the club head face opens to the right after a delay and the ball flies to the right or becomes a sliced ball. Over uncocking in the business zone can cause duffing. Over-uncocked in the downswing zone causes the club head to move away from the body and take a long time to impact, causing a delay in swinging. The over-uncocked in the follow zone is difficult to catch the ball and tends to become a sliced ball. For these improvements, it is necessary to maintain an appropriate grip angle for each zone in each zone so that it does not become over-uncocked. However, most non-advanced golfers try to swing the club head in a circular orbit when the downswing from the top starts, and the club head moves away from the body and the grip angle becomes larger than the predetermined angle of 90 degrees, and the golf club I can't control and hit the ball as I want. And unfortunately, many golfers stop playing golf because they feel "golf is difficult" without realizing that their swing is over-uncocked.

From the above, the present invention has the following form. First, both arm bands 10 and the club shaft 23 are connected by a string-like member so that the grip angle does not become larger than a predetermined grip angle. The second is the low-elasticity string-like member 40 shown in FIGS. 5, 6 and 7, the high-elasticity string-like member 50, and the composite string-like member in which the high-elasticity string-like member 50 and the low-elasticity string-like member 40 are bundled. Three types of string-shaped members of 60 are used to enable various exercises so that the grip angle does not become larger than each predetermined grip angle. Third, in order to facilitate the rotation of both arms, an arm tightening band 15 that brings both elbows close to each other is attached to both arms (see FIG. 8). In addition, the arm band 10 has a function of setting both elbows at a predetermined distance by means of an arm tightening connecting body 14 whose length can be changed. Fourth, since the grip angle is frequently changed during practice, the fastener 30 whose grip angle can be easily changed is shown in FIG. The grip angle can be easily changed because the locking position of the fastener 30 can be changed by simply sliding the fastener 30 with one touch. When the fastener 30 is locked closer to the club head 21, the grip angle will be smaller.

The distance from the arm band 10 to the fastener 30 is constantly changing. Therefore, the low-elasticity string-like member 40 is mainly used for practice in the business zone and practice for acquiring the image of the accumulating energy in the downswing zone. The length of the low elasticity string member 40 is equipped with two rings whose mounting position can be determined by the user's body shape and posture when using for the first time, one for the business zone and the other for the downswing zone. Horizontal arc swing and inclined arc swing in the business zone using the low elasticity long ring 42 of the low elasticity string member 40, and accumulating energy making and vertical swing in the downswing zone with the low elasticity short ring 41 of the low elasticity string member 40. You can practice.

Using the highly elastic string-like member 50, you can practice and perform a full swing in each of the business zone, downswing zone, and follow zone. Individually, when changing the strength of the tension of the high-elasticity string-shaped member 50 significantly, use the two rings provided on the high-elasticity string-shaped member 50, and fine-tune the locking position of the fastener 30.

When high-elasticity string-like member 50 is configured one high-elasticity string-like member, if it breaks during use, the high-elasticity string material may fly toward the golfer due to the tension. Therefore, for safe use, the high-elasticity string-like member 50 is a bundle of multiple high-elasticity string materials, and even if one is broken, the other high-elasticity string materials ensure safety. An example of how to bundle is the triplet shown in FIG. 5. The tension can be increased or decreased by increasing or decreasing the number of highly elastic string members that make up the highly elastic string-like member 50. It is easy for the user of the present invention to purchase the highly elastic string material by himself/herself.

FIG. 7 shows the mechanism of the composite string-like member 60 that bundles the high-elasticity string-like member 50 and the low-elasticity string-like member 40, and FIG. 4 shows how it is in use. Both string-like members are bundled at the nodal point 55. You can practice full swing with the composite string member 60, the high elasticity string member 50 prevents over uncocking in the downswing zone, and the low elasticity string member 40 prevents over uncocking in the business zone. At this time, the high elasticity short ring 51 and the low elasticity long ring 42 are used.

The fastener 30 in FIG. 3 is made of an elastic material and has a shape that wraps around the club shaft 23, and is pressed against the outer peripheral surface of the club shaft 23 on the inner surface to lock the club shaft 23. A non-slip 35 such as rubber plate can be attached to the inner surface of the fastener 30. Since the fastener 30 has a shape that wraps around the club shaft 23, it locks on the club shaft from the putter to the driver. The open lever 31 in FIG. 3 opens the fastener 30 using the principle of leverage. To change the grip angle, open the fastener 30 that locks to the club shaft 23 by pinching the open lever 31 and slide it to change the position of the fastener 30 that locks to the club head 21 simply by releasing the finger from the open lever 31. The grip angle decreases as the position of the fastener 30 is locked closer to the club head 21, and the grip angle increases as the distance from the club head 21 increases.

Figure 1:
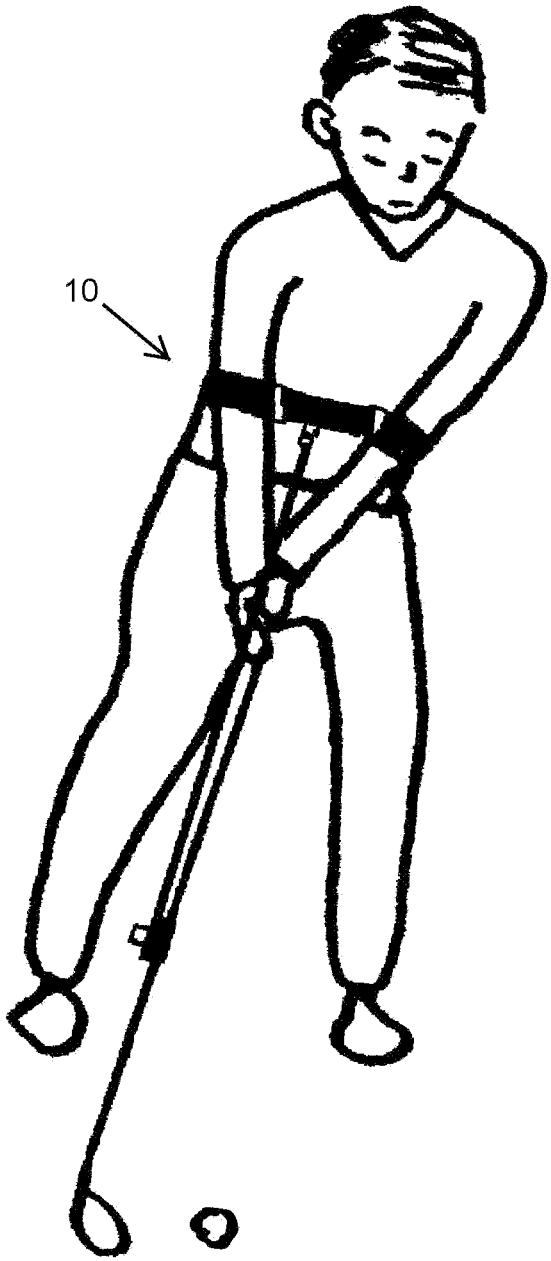
FIG. 1 is a figure in which a right-handed golfer is wearing the present invention and hitting a ball.
Figure 2:
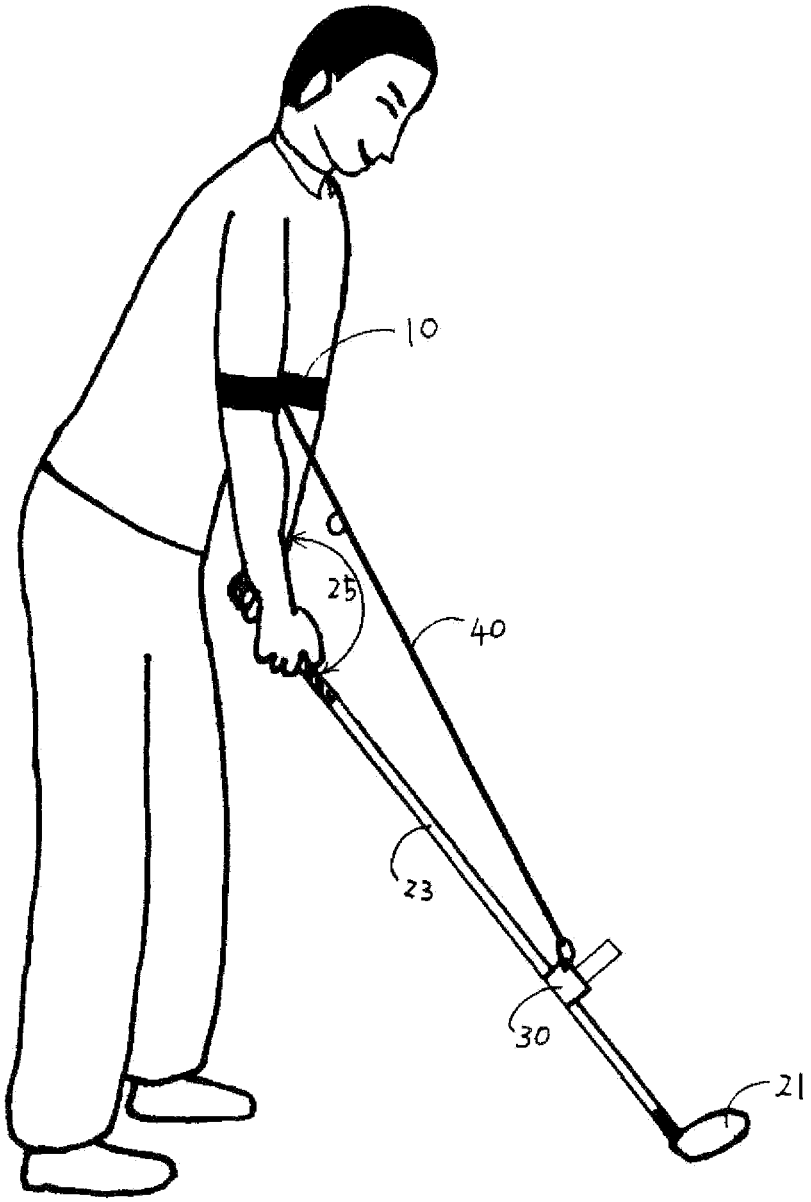
FIG. 2 illustrates a grip angle 25. The open lever 31 is in a standing state.

When the composite string-shaped member 60 is used, the low-elasticity string-shaped member 40 may be entangled with the slack opening lever 31 when the open lever 31 is spread downward. Therefore, when the string-shaped member 60 is used, the open lever 31 is maintained in an upright state as shown in FIG. 2. The low-elasticity string-like member 40, the high-elasticity string-like member 50, and the composite string-like member 60 can be attached and detached by attaching the string-like member tip hook 44 provided at the tip of the string-like member to the fastener ring 33 and the rear end of the string-like member. Lock each ring provided in the above to the two-arm band hook 11.

The two arm tightening bands 15 are connected to the arm tightening connecting body 14 by two connecting tools 17. The arm tightening connecting body 14 allows the distance between both elbows to be adjusted by both elbow spacing adjusting tool 13. It is desirable that both elbows are close to each other in order to easily cause rotation. For putting that dislikes rotation, keep both elbows away. Since the length of the arm tightening band connection 14 can be adjusted, you can find the optimum distance between the elbows by changing the distance between the elbows. The arm tightening connecting body 14 is provided with the arm band hook 11 in order to lock one end of the string-like member to the middle portion between the right arm and the left arm. This allows different elbow movements on the left and right to be transmitted to the string members during the swing. For example, the right elbow is close enough to touch the body when making an accumulating energy during a downswing. At this time, the distance from the fastener 30 to both elbows is different (see position A in FIG. 10). The left elbow is extended by the swing (excluding the finish), but the angle of the right elbow changes from around 90 degrees to 180 degrees, so the distance from the fastener 30 to both elbows is different. If one end of the string-like member is locked only on one elbow, only the movement of one elbow will be transmitted to the string-like member.

FIG. 9 shows the arm tightening band 15. To attach the arm tightening band 15, lift the band removal prevention device 18 to tighten the arm, tilt the band removal prevention device 18 and bring it into contact with the hook-and-loop fastener 12 to lock it. The left (right) arm tightening band 15 can be easily locked with the right hand (left hand), so no other person's help is required. When taking back, the muscles of the right arm rise, so tighten the arm tightening band 15 of the right arm looser than the left arm tightening band 15.

It is possible to install an electronic device that sounds an alarm when the tension of the string-shaped member exceeds the specified value. It is advisable to install an electronic device between the arm band 10 and the arm band hook 11 so that the influence of the weight is reduced.

EXAMPLE

Examples of the present invention will be described in the order of practice of the present invention. A table of 12 types of practice menus possible in the present invention is shown in FIG. 11.

Use of low elasticity long ring 42—Horizontal arc swing. Horizontal arc swing is the basis of all swings (excluding putting). Start with the basic horizontal arc swing. It is a good idea to start practicing horizontal arc swing with an approach wedge or a pitching wedge. Use the two-elbow spacing adjuster 13 of the arm tightening connecting body 14 to set the spacing between the two elbows. The string-shaped member tip hook 44 of the low-elasticity string-shaped member 40 is locked to the fastener ring 33 of the fastener 30. Fasten the fastener 30 around the center of the club shaft 23, and lock the low elastic length ring 42 to the two-arm band hook 11. Wear arm band 10. Adjust the grip angle by sliding the fastener 30 so that the grip angle is 150 to 160 degrees with the club head 21 floating 2 to 3 cm above the ground in the normal address posture.

Over-uncocking is about to occur where the tension of the low-elasticity string-shaped member 40 becomes stronger by swinging symmetrically in the business zone, but the low-elasticity string-shaped member 40 does not allow over-uncocking. In the horizontal arc swing, the swing image is grasped by swinging so that the tension becomes constant in the business zone. To maintain the grip angle, vertical force and the rotation of arms are needed not to be delay swing. The main goal of a horizontal arc swing is to experience a swing that is not over-uncocked. If the swing is not over uncocked, the speed after 6 o'clock will naturally increase. During this practice, you will naturally learn that you need to hold the club shaft firmly with the three fingers from the little finger of your left hand to maintain the grip angle. Next, when you actually hit the ball with the present invention attached, you can realize that duffing and top balls are less likely to occur. You can further reduce duffing by learning the tilted arc swing described later. If you can prevent duffing due to over-uncocking, you will not have to unknowingly "stretch" to escape from duffing. A golfer who has a growth will be surprised at his growth when he uses this invention, saying, "Well, I have stretched so much!". Not being able to see your own golf swing is one of the factors that make golf difficult. So I do what I shouldn't do, I don't do what I should do. Golfers can experience this with the present invention.

Use of low elasticity long ring 42—Inclination arc swing. Since the swing is similar to using the low elasticity string-like member 40, the practice of inclining arc swing will be explained here. You can skip this tilting arc swing practice and use it as the final practice. In the case of horizontal arc swing, the ball is hit at the lowest point of the arc, but it is unreasonable unless it is a machine to always bring the lowest point, which is the point where the movement of the club head changes from downward to upward, exactly under the ball. If the lowest point comes to the right side of the ball even a little, the ball will be hit after the lowest point, the direction of the club head face will be higher than the predetermined direction, the ball will rise more than expected, and the flight distance will be shorter. If the lowest point comes to the left side of the ball even a little, the ball will pop out lower than planned. If you don't hit it, you won't know the result. To prevent this, hit the ball at a point other than the lowest point, but if the lowest point is to the right of the ball, the club head will hit the ground before hitting the ball, which is duffing. Therefore, the lowest point is to the left of the ball. Then, the direction of the club head face hits the ball in a predetermined direction, then the lowest point comes and the direction of the club head face turns upward. When the club head face hits the ball in the specified direction, the flight distance and height can be assumed. Since the club head face hits the ball while it is descending toward the lowest point, the backspin is applied to the ball and the ball stops immediately. The lowest point is to the left of the ball, resulting in a turf. Taking turf is a result, not a purpose. Since there is no change in the direction of the club head face due to impact, you can hit with a high club head speed and it will be a strong ball.

When the golfer who hits the ball at the lowest point of the horizontal arc swing is seen from the front, the club head is directly under the grip. When the golfer who hits the ball before the lowest point is seen from the front, the grip is to the right of the club head, so it is called hand first Professional golfers and advanced players dislike the variation in flight distance and hit the ball with hand first. The good points of hand first are that you can hit the ball directly while avoiding the quality and unevenness of the ground, and you can hit the ball with the club head face in the specified direction than the horizontal arc swing, so you can hit the ball as expected. The accelerated club head in downswing goes straight to the ball as it is, so it becomes a strong ball.

To hit the ball with hand first, raise the right side of the horizontal arc swing arc and lower the left side. If you swing the horizontal arc so that the lowest point comes to the lower left of the ball, it will swing in a slanted arc, and it will be a hand-first swing. The point to note is to keep the grip angle at the address grip angle to the lowest point even after impact. Professional golfers make full use of further technology, so I will explain it in a dozen lines later.

Uses the highly elastic long ring 52—horizontal arc swing and tilted arc swing. The highly elastic string-shaped member 50 is used. Use the high elasticity short ring 51 or the high elasticity long ring 52 to obtain the desired tension. Make fine adjustments with the fastener 30 so that a little tension is generated. Swing a horizontal arc so that the tension of the highly elastic string-shaped member 50 becomes constant. The low-elasticity string-like member 40 does not allow over-uncocking at all, but using the stretchable high-elasticity string-like member 50, if the practitioner does not have a strong awareness of maintaining the grip angle, it will become over-uncocked. So it's good practice to keep the grip angle. Let's hit the ball using the highly elastic string-shaped member 50. Next, in the same way as the practice of the low elasticity string member 40, practice the tilted arc swing, that is, the hand first with the high elasticity string member 50. It is the same as the practice of the low elasticity string member 40.

If you want to hit a turf with an iron club like a professional golfer, practice using the highly elastic string-shaped member 50. The way to take a professional golfer level turf is to keep the accumulating energy until about 7 o'clock or 6:30 o'clock (at this time, keep the right elbow bent), and then suddenly start vertical swing, that is, rotation, and make an impact. Keep the specified grip angle (address grip angle) up to this point. After impact, extend the right elbow to swing the club head in the direction of the fly ball (the grip angle will increase after impact). In this professional golfer level striking method, the grip angle becomes larger than the address grip angle after impact and the club head moves away from the body, so the highly elastic string-shaped member 50 is suitable for this practice. The practice of finishing is to hit the ball using the highly elastic string-shaped member 50.

This section describes how to improve the over-uncock in the downswing zone using the present invention.

Use of low elasticity short ring 41—Accumulating energy. As can be seen in the continuous photographs of golf magazines, the arc of the club head during the downswing of an advanced player is clearly smaller than the arc during takeback. The downswing starts at a grip angle of about 90 degrees and approaches the address grip angle of 150 degrees around 7 o'clock. The reason for doing so is that during a downswing, the club head 21 moves away from the body in a large arc, making it difficult to control the club head 21. A large amount of force is required in both hands to control the club head 21 that has moved away. However, it is difficult to control the club head 21 that has moved away even with great force of both hands, and the swing after this is greatly disturbed. The club head 21 that has moved away takes a long time to impact and a swing delay occurs. In the delay, the upper body is facing the front, but the club head is still on the right side of the front, and when the club head comes to the front, the upper body is facing slightly to the left. As a result, the club head face opens and hits the ball. The club head speed will also be slower. At the beginning of the downswing, it is necessary to keep the top grip angle so that the club head does not move away from the body. This is called making an accumulating energy. Non-advanced golfers will not be able to make an accumulating energy because the grip angle will increase as soon as the downswing starts. As a result, club control becomes difficult.

The low elasticity string member 40 is suitable for the first practice of making an accumulating energy. The low elasticity short ring 41 of the low elasticity string member 40 is used. Raise the grip 29 to the position A (10 to 11 o'clock) in FIG. 10. If the grip angle is not 90 degrees, slide the fastener 30 toward the club head 21 and set it so that the grip angle is 90 degrees and the low elasticity string-like member 40 does not sag. When the grip 29 is raised to the position A in FIG. 10, the upper body turns to the right. Always keep your upper body facing right between A and B in FIG. 10 during practice and game when performing accumulating energy and vertical swings. If both shoulders rotate during the downswing, the club head will come out and become an outside-in swing, resulting in a sliced ball that bends to the right. From A to B in FIG. 10, leave the upper body as it is and lower the grip.

Even if the grip is lowered directly below from the position A to the position B in FIG. 10, the grip angle is maintained at 90 degrees due to the effect of the present invention. The club head does not move away from the left shoulder due to the movement from A to B in FIG. The reason is that the shape of the triangle formed by the club shaft 23, the arm and the low elasticity string member 40 does not change, and the center of rotation of the triangle is the left shoulder. The position of the club head B in FIG. 10 has moved to the left of the position of the club head A, but this is due to the rotation of the triangle, and the size of the grip angle has not changed. Some golfers reduce the grip angle to 90 degrees or less in Figure B to reduce the movement of the club head from A to B in FIG. 10. In the Tiger Woods swing photo, there is a photo with a grip angle of 90 degrees or less at position B. How to make an accumulating energy is easy as described above. However, many golfers will soon have a large grip angle from A in FIG. 10. Even if I explain this in words, it is difficult to convey it. The present invention is very effective for understanding the accumulating energy and creating an image. No words are required in the present invention because the accumulating energy is made by physical coercion.

Well, I wrote that I will leave the upper body as it is. What if you start rotating your upper body at the same time as the downswing starting from A in FIG. 10? It is difficult to make an accumulating energy. In addition, the upper body immediately faces the ball, but the club is still on the right side of the upper body and it is impossible to hit the ball, it is a delay. So golfers who can't make an accumulating energy seek bad solution. That's why you should stop your upper body.

Use of low elasticity short ring 41—Vertical swing. The purpose here is to obtain an "image" of vertical swing. The low elasticity short ring 41 of the low elasticity string member 40 is used. When the arms from A to B in FIG. 10 are accumulating energy, both arms are automatically ready for vertical swing at the position B in FIG. 10. As described immediately after "Definition of terms" in "Problems to be solved by the invention", adduction and abduction are natural movements when the arm is rotated greatly, so the swing is continued after B in FIG. To do this, start abduction of the left arm and adduction of the right arm at position B, and move the club head toward you from the drawing at position B. This is a vertical swing. At this time, the low elasticity string-like member 40 does not allow the club head to move to the left in the drawing and forcibly rotates the club head toward the front of the drawing. The movement of the accumulating energy from A to B in FIG. 10 is parallel to the drawing, and the movement after B in FIG. 10 is the movement perpendicular to the drawing. Since the arm band 10 brings both elbows close to each other, it facilitates abduction and adduction, that is, rotation of both arms. After the vertical swing, the grip angle gradually increases and tries to reach the address grip angle (thus the club head is far away), but since the length of the low elasticity string member 40 is constant, the swing ends 8:30 in B of FIG. 10.

I wrote that the club head starts from B in FIG. 10 due to the adduction and abduction (rotation) of the arm, but there is a time lag for the club head to start the vertical swing movement to the club head at the position B in FIG. 10. Because there is, you have to apply the rotation force in front of the B position. By the way, if you apply the rotation force from 10 o'clock, it will become a hook ball, and if you apply the rotation force from 8 o'clock, it will become a fade ball.

You can experience another important thing by practicing vertical swing. When you swing vertically, the grip angle works, and the club head naturally starts to move to the left. If there is no accumulating energy (the grip angle is large) and the club head goes to the left of B in the figure, it is difficult to move the club head to the left with a large grip angle even if it is rotated with a rigid force. Try adding and abducting at a grip angle of 180 degrees with the grip position at 6 o'clock, the club head just rotates on the spot with the club shaft as the rotation axis. However, if the grip angle is 150 degrees and the adduction and abduction are performed, the club head will move greatly from side to side. In a golf swing, instead of swinging the golf club with rigid force, you understand and acquire the mechanical movement of the body to make the desired movement naturally and automatically. The present invention requires mechanical body movements. Now, let's repeat the practice of making an accumulating energy and continuing to swing vertically.

The explanation of the vertical swing part using the low elasticity string member 40 is slightly different from the actual vertical swing. The purpose is to get an image of vertical swing, and the explanation and practice method of actual vertical swing will be described below.

Use of high elasticity short ring 51 Accumulating energy and Vertical swing. Use high elasticity short ring 51 of high elasticity string member 50. Raise the grip 29 to the position shown in FIG. A in FIG. 10 in the same way as Accumulating energy using the low elasticity string member 40. If the grip angle is not 90 degrees, slide the fastener 30 toward the club head 21 and set it so that the grip angle is 90 degrees and the highly elastic string-like member 50 does not sag. When the grip 29 is raised to A in FIG. 10, the upper body turns to the right. And the upper body is facing right until the position of B.

Accumulating energy and vertical swing practice using the high elasticity string member 50 is the same as the above practice method using the low elasticity string member 40, but since the high elasticity string member 50 stretches, the golfer adjusts the grip angle accordingly. Must be kept. In FIG. 10, the tension of the highly elastic string-shaped member 50 is weak during the time between A and B, and the grip angle gradually increases when swinging vertically starting from B, so the tension gradually increases. Since the goal here is to understand the accumulating energy and vertical swing, the swing ends at 6 o'clock in B of FIG. 10.

The triangle made of the arm, shaft and string member of A in FIG. 10 is equal to the triangle made of the arm, shaft and string member of B in FIG. 10. As mentioned above, if the grip is lowered while twisting the body to the right from A in FIG. 10, the triangle formed by the club shaft 23, the arm, and the highly elastic string-like member 50 makes a circular motion, the center of which is the left shoulder even if the grip angle is kept at 90 degrees. The club head moves to the right due to the circular motion whose center is left shoulder. The club head continues to arc to the right during vertical swing and the club head moves forward due to the rotation of the last timing of vertical swing. In other words, moving to the right and the rotation are combined, so the club head moves forward, as a result, the club head traces on the swing plane. ("Tracing" does not mean that the distance between the golfer's body and the club head is constant, it means that the club head is on the swing plane).

Use of high elasticity short ring 51—Top from Finish. Use high elasticity short ring 51 of high elasticity string member 50. Start from the position shown in Figure A in FIG. 10 without taking back. From FIG. A, while feeling the tension of the highly elastic string-shaped member 50, make an accumulating energy until the B position and start vertical swing from the B position, the grip angle gradually increases toward the address grip angle and the tension increases while enter to the business zone. Even in the business zone from 8 o'clock, tension tries to prevent over-uncocking. After the strongest impact, tension and rotation of both arms lead to a natural follow and finish. As mentioned above, professional golfers and advanced golfers maintain their accumulating energy until around 7 o'clock. If you want to start rotation of vertical swing from 8 o'clock on the downswing, start putting effort to make vertical swing from 9 to 10 o'clock before that.

Uses composite string-shaped member 60—Top to finish. Uses both a low elasticity long ring 42 and a high elasticity short ring 51. It is a practice to complete a full swing from the top to the finish. This is a practice using the composite string-like member 60 as shown in FIG. 4. The low elasticity long ring 42 of the low elasticity string member 40 and the high elasticity short ring 51 of the high elasticity string member 50 are used. In the full swing, the high elasticity string member 50 in the downswing and the low elasticity string member 40 in the business zone prevent over-uncocking.

Putting. The main methods for hitting a putter are to pull the putter club linearly backward and launch it linearly, or to pull it backward in an arc shape and launch it in a forward arc shape. Even in the method, if the low elasticity string member 40 and the high elasticity string member 50 of the present invention are used, the putter club can be moved smoothly and stably. Putting is usually done with both elbows slightly spread out so as not to use arm rotation. The arm tightening connecting body 14 of the present invention can set the distance between both elbows to a desired distance.

CODE DESCRIPTION

10 Arm band,
11 Arm band hook,
12 hook-and-loop fastener,
13 Both elbow spacing adjuster,
14 arm tightening connecting body,
15 Arm tightening band,
16 Arm tightening tool,
17 Connecting tool,
18 Band removal prevention tool
21 club head,
23 Club shaft,
25 Grip angle,
29 Grip,
30 Fastener,
31 Open lever,
32 Lever holder,
33 Fastener ring,
35 Anti-slip,
37 Lever holder notch,
38 Fastener hole,
40 Low elasticity string member,
41 Low elasticity short ring,
42 Low elasticity long ring,
44 String member tip hook,
50 High elasticity string member,
51 High elasticity short ring,
52 High elasticity long ring,
55 nodal points,
60 composite string-like members.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. § 1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A golf swing training tool comprising:

a pair of arm tightening bands configured to be worn at a left arm and a right arm of the user;

an arm tightening connecting body connecting said pair of arm tightening bands together;

a fastener to be locked to an existing golf club shaft;

a grip angle defined between one of the left arm and the right arm of the user as well as a longitudinal length of the existing golf club shaft; and a string-like member having one end locked to said arm tightening connecting body, and further having an opposite end locked to said fastener;

wherein said pair of arm tightening bands are configured to cooperate with said arm tightening connecting body and restrict a distance between a left elbow and a right elbow of the user;

wherein said string-like member is configured to restrict a distance between said arm tightening connecting body and said fastener and thereby prohibit said grip angle from becoming larger than a predetermined grip angle.

2. The golf swing training tool of claim 1, wherein said fastener is elastic and is to be wrapped about the golf club shaft;

wherein said fastener is configured to be adjustably locked along the longitudinal length of the golf club shaft to selectively change said predetermined grip angle.

3. The golf swing training tool of claim 2, wherein a longitudinal length of said arm tightening connecting body is selectively adjustable and configured to selectively adjust said distance between the left elbow and the right elbow of the user.

4. The golf swing training tool of claim 2, wherein said string-like member includes a plurality of hooks locked to said fastener and said arm tightening connecting body, respectively; wherein said pair of arm tightening bands configured to smoothly transmit movement of said left elbow and said right elbow to said string-like member.

5. The golf swing training tool of claim 1, wherein said string-like member comprises:

a first string-like member having a low elasticity; and a second string-like member having a high elasticity.

* * * * *